US008590563B2

(12) United States Patent
Martin et al.

(10) Patent No.: US 8,590,563 B2
(45) Date of Patent: Nov. 26, 2013

(54) DEVICE FOR DELIVERING FUEL

(75) Inventors: Eugen Martin, Bietigheim-Bissingen (DE); Ludger Kuermann, Schwieberdingen (DE); Miloslav Gabris, Ceske Budejovice (CZ)

(73) Assignee: Robert Bosch GmbH, Stuttgart (DE)

( * ) Notice: Subject to any disclaimer, the term of this patent is extended or adjusted under 35 U.S.C. 154(b) by 144 days.

(21) Appl. No.: 13/259,276

(22) PCT Filed: Mar. 5, 2010

(86) PCT No.: PCT/EP2010/052824
§ 371 (c)(1),
(2), (4) Date: Sep. 23, 2011

(87) PCT Pub. No.: WO2010/115668
PCT Pub. Date: Oct. 14, 2010

(65) Prior Publication Data

US 2012/0018019 A1 Jan. 26, 2012

(30) Foreign Application Priority Data

Apr. 9, 2009 (DE) ..... 10 2009 002 299

(51) Int. Cl.
*F04F 5/00* (2006.01)

(52) U.S. Cl.
USPC ..... 137/565.22; 123/514

(58) Field of Classification Search
USPC ..... 137/565.22; 123/510, 511, 514, 516; 417/87, 198
See application file for complete search history.

(56) References Cited

U.S. PATENT DOCUMENTS

| | | | | |
|---|---|---|---|---|
| 4,285,770 | A * | 8/1981 | Chi et al. | 376/407 |
| 5,396,872 | A | 3/1995 | Ruger et al. | |
| 6,123,511 | A | 9/2000 | Sertier | |
| 6,457,945 | B2 | 10/2002 | Kleppner et al. | |
| 6,619,272 | B2 * | 9/2003 | Jones et al. | 123/514 |
| 6,679,226 | B2 * | 1/2004 | Burke et al. | 123/509 |
| 6,955,158 | B2 * | 10/2005 | Rumpf | 123/514 |
| 6,997,168 | B2 | 2/2006 | Schueler et al. | |
| 7,252,075 | B2 * | 8/2007 | Firtion et al. | 123/509 |
| 7,303,378 | B2 * | 12/2007 | Kleppner et al. | 417/87 |
| 2002/0083983 | A1 | 7/2002 | Coha et al. | |
| 2003/0121550 | A1 * | 7/2003 | Braun et al. | 137/565.22 |
| 2007/0104589 | A1 | 5/2007 | Marx | |

FOREIGN PATENT DOCUMENTS

| | | |
|---|---|---|
| DE | 4432968 | 3/1996 |
| EP | 1302354 | 4/2003 |

OTHER PUBLICATIONS

PCT/EP2010/052824 International Search Report Nov. 6, 2010.

* cited by examiner

*Primary Examiner* — John Rivell
*Assistant Examiner* — Angelisa Hicks
(74) *Attorney, Agent, or Firm* — Michael Best & Friedrich LLP

(57) ABSTRACT

The present invention includes a device that comprises a suction jet pump, that is arranged in a reservoir pot and has a nozzle and a mixing duct provided downstream the nozzle and arranged perpendicular to a pot base of the reservoir pot. The outlet of the mixing duct has a deflection means, which the jet of the nozzle impinges when the mixing duct is unfilled and has an additional volume formed at the outlet of the mixer by an offset widening of the mixer duct. This additional volume prevents the column of liquid in the mixing duct from being forced out by the propulsion jet of the suction jet pump. Thus the lead time of the suction jet pump is approximately equal in all operating states.

9 Claims, 1 Drawing Sheet

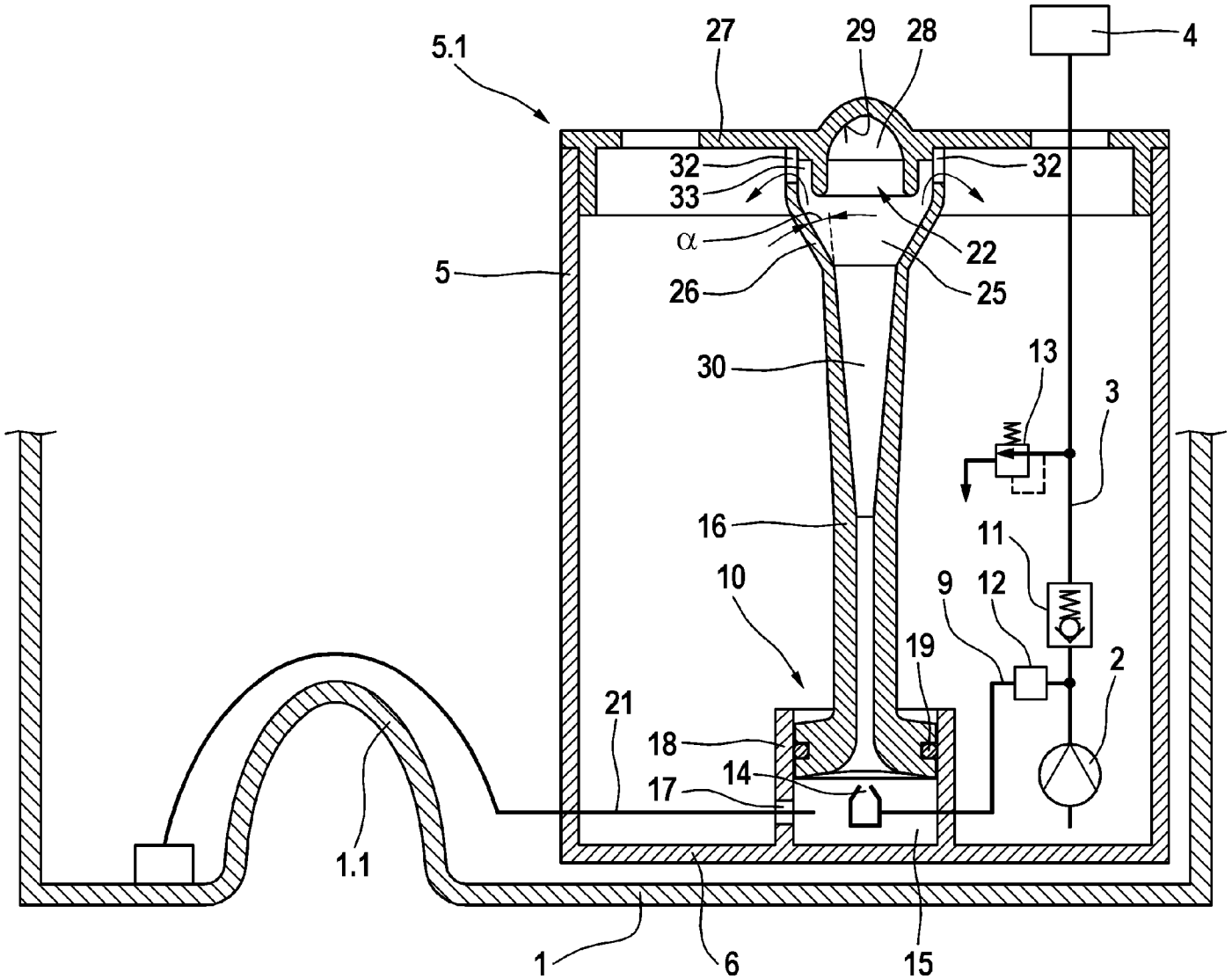
4
3
2
13
11
12
9
32
22
25
28
29
19
15
27
32
33
α
26
30
16
10
14
18
17
6
21
1
5.1
5
1.1

DEVICE FOR DELIVERING FUEL

BACKGROUND OF THE INVENTION

The invention starts from a device for delivering fuel.

A device comprising a suction jet pump, which is arranged in a reservoir pot and has a nozzle and a mixing duct provided downstream of the nozzle and arranged perpendicular to a pot base of the reservoir pot, wherein at the outlet of the mixing duct a deflection means is arranged, against which the jet of the nozzle impinges when the mixing duct is substantially unfilled and, in the process, is at least partially guided back into the mixing duct, is already known from DE 42 19 516 A1. It has been found that, despite the deflection means, the propulsion jet has a tendency to expel the column of liquid in the mixing duct. As soon as the liquid level in the reservoir pot has fallen below the outlet of the mixing duct, no more fuel can flow into the mixing duct from above, with the result that the mixing duct may be unfilled after the suction jet pump is switched off. When the suction jet pump is restarted, an unsatisfactorily long delay then occurs before the beginning of induction by the suction jet pump because the volume of the propulsion jet must first fill the mixing duct in order to build up a vacuum and suction power.

DE-100 03 748 A1 has disclosed a device which is arranged in a saddle-type fuel tank and has a fuel delivery pump arranged in a reservoir pot and two suction jet pumps. The saddle-type fuel tank is divided into two regions by a saddle, the reservoir pot with the fuel delivery pump and the first suction jet pump being provided in one region and the second suction jet pump being provided in the other region. An additional propulsion line, which has to be laid in the saddle-type fuel tank in an involved process, is required for the second suction jet pump.

US 2002/083983 A1 has furthermore disclosed a device arranged in a saddle-type fuel tank which has a fuel delivery pump arranged in a reservoir pot and two suction jet pumps. Both suction jet pumps are arranged in the reservoir pot, the first suction jet pump drawing in fuel from the immediate surroundings of the reservoir pot and the second suction jet pump drawing in fuel from a region of the saddle-type fuel tank on the other side of the saddle. The second suction jet pump has an unsatisfactorily long starting time up to the onset of suction power, owing to the lack of a deflection means.

SUMMARY OF THE INVENTION

In contrast, the device according to the invention has the advantage that a situation where the column of liquid in the mixing duct is forced out by the propulsion jet of the suction jet pump is avoided by forming an additional volume at the outlet of the mixing duct by an offset widening of the mixing duct. This provides an additional hydrostatic pressure which prevents the mixing duct from being emptied by the propulsion jet. As a result, the starting time of the suction jet pump up to the start of induction is approximately the same for all operating states. Moreover, continuous induction is ensured for all operating states. The widening of the mixing duct in the additional volume, especially a conical widening, allows better capture and return of the jet of the nozzle into the mixing duct.

It is particularly advantageous if the deflection means is a depression, recess, receptacle or skirt, into which the jet of the nozzle impinges, the jet being guided back into the mixing duct by the deflection means. The depression, recess, receptacle or skirt has an inlet facing the mixing duct, with the inlet of the deflection means extending into the additional volume. This ensures that less liquid is lost from the mixing duct through splashing.

BRIEF DESCRIPTION OF THE DRAWING

An illustrative embodiment of the invention is depicted in simplified form in the drawing and explained in greater detail in the following description.

DETAILED DESCRIPTION

The drawing shows a section through a device for delivering fuel comprising a suction jet pump according to the invention.

The device for delivering fuel is arranged in a fuel tank 1 and delivers fuel from the fuel tank 1 at an increased pressure to an internal combustion engine 4 via a pressure line 3 by means of a delivery unit 2, e.g. a fuel pump. The delivery unit 2 is arranged in a reservoir pot 5, which holds sufficient fuel for the delivery unit 2 to ensure that said unit can draw in fuel even when the level of fuel in the fuel tank 1 is low and during acceleration, braking, cornering and/or hill climbing. The reservoir pot 5 has a pot base 6. Branching off from the pressure line 3 of the device is a propulsion line 9, which drives a suction jet pump 10 for active filling of the reservoir pot 5. A pressure control valve 12 can be provided in the pressure line 3 or in the propulsion line 9, said valve allowing fuel to flow out of the pressure line 3 into the propulsion line 9 only above a predetermined pressure in the pressure line 3. As an alternative, the pressure control valve 12 can be replaced by a restrictor element 12, which limits the volume flowing off into the propulsion line 9. A check valve 11 is provided in the pressure line 3 downstream of the branch point of the propulsion line 8, preventing fuel from flowing back and maintaining the pressure in the pressure line 3 downstream of the check valve 11 after the delivery unit 2 is switched off. Of course, the propulsion line 9 can also be supplied with fuel by a return (not shown) from the internal combustion engine 4 or in some other way. Moreover, it is possible to provide a pressure relief valve 13, which allows fuel to escape from the pressure line 3 at a predetermined excess pressure in the pressure line 3 in the section downstream of the check valve 11.

The propulsion line 9 opens via a jet outlet 14, which is narrowed for example and can form a nozzle, into an intake chamber 15 of the suction jet pump 10. Adjoining the intake chamber 15 is a mixing duct 16, which is arranged on an imaginary extension of the jet outlet 14 in such a way that a jet of fluid emerging from the jet outlet 14 of the propulsion line 9 passes in a straight line via the intake chamber 15 into the mixing duct 16. The mixing duct 16 extends transversely, e.g. vertically, to the pot base 6. The perpendicular arrangement of the mixing duct 16 allows more installation space for a configuration of the suction jet pump 10 which is more favorable in terms of flow, particularly at the end of the mixing duct 16, thus improving efficiency over horizontally arranged mixing ducts.

The operation of the suction jet pump 10 is sufficiently well known and it will therefore be described only briefly here: via the propulsion line 9 and the jet outlet 14 thereof, a propulsion flow is introduced into the suction chamber 15 in the form of a jet. The propulsion jet from the propulsion line 9 entrains surrounding fuel from the intake chamber 15 into the mixing duct 16, thus establishing a delivery flow into the reservoir pot 5 via the mixing duct 16. A vacuum arises in the intake chamber 15, causing more fuel to flow out of the fuel tank 1 into the intake chamber 15 via an intake opening 17 of the intake chamber 15.

The intake chamber 15 is formed by a pot-shaped receptacle 18, for example, on the pot base 6, into which the mixing duct 16 is inserted as a separate component. A sealing ring 19, for example, is provided between the inserted section of the mixing duct 16 and the receptacle 18 to provide sealing. Connected to the intake opening 17 there is, for example, an intake line 21, which leads into a region of the fuel tank 1 remote from the reservoir pot 5. The intake line 21 is passed over a saddle 1.1 of the fuel tank 1, for example, and draws fuel out of a region separated by the saddle 1.1 from a section of the fuel tank 1 in which the device according to the invention with the reservoir pot 5 is arranged.

The mixing duct 16 is arranged in the direction of the longitudinal extent of the reservoir pot 5, e.g. perpendicularly to the pot base 6, and is held in the receptacle 18, it being possible for the pot lid 27 to fix the mixing duct 16 in the axial direction.

A deflection means 22, against which the propulsion jet impinges when the mixing duct 16 is unfilled and, in the process, is at least very largely guided back into the mixing duct 16, is arranged at the outlet of the mixing duct 16.

To prevent the mixing duct 16 from being emptied by the powerful propulsion jet, the invention makes provision for an additional volume or reservoir 25 to be formed by a radial widening 26 of the mixing duct 16 at the outlet or end section of the mixing duct 16 remote from the nozzle 14. The additional volume 25 according to the invention provides an additional hydrostatic pressure which prevents the fuel from being expelled from the mixing duct 16. The widening of the mixing duct 16 in the region of the additional volume 25, according to the illustrative embodiment at the end of the diffuser 30, furthermore allows better capture and return of the jet of the nozzle 14 into the mixing duct 16.

The widening of the mixing duct 16 takes place in the radial direction relative to the longitudinal extent of the mixing duct 16. The widening of the mixing duct 16 means that the wall of the additional volume 25 is angled in such a way relative to the wall of the adjoining remainder of the mixing duct 16 that there is an angle $\alpha$ unequal to zero between the two sections. The widening of the mixing duct 16 is offset, step-shaped, shoulder-shaped, conical or the like, for example. A section 30 of the mixing duct 16 embodied as a diffuser which widens in the direction of flow can be provided underneath the additional volume 25 or upstream of the additional volume 25.

The deflection means 22 is embodied in the form of a lid or cap and covers the front end outlet of the mixing duct 16. According to the illustrative embodiment, the deflection means 22 is formed integrally on a lid 27 of the reservoir pot 5, but it can also be a separate part. The additional volume 25 of the mixing duct 16 extends as far as or into the vicinity of a rim 5.1 of the reservoir pot 5, for example, thus enabling as high a hydrostatic pressure as possible to be built up in the mixing duct 16.

The deflection means 22 has a depression, recess, receptacle or skirt 28, into which the jet of the nozzle 14 impinges, at least when the mixing duct 16 is unfilled. This depression, recess, receptacle or skirt 28 is embodied in the form of a cylinder, channel, pot or blind hole, for example. The depression, recess, receptacle or skirt 28 has an inlet facing the mixing duct 16, with the inlet of the deflection means 22 extending into the additional volume 25. In this way, losses of liquid due to splashing of fuel are reduced. The depression, recess, receptacle or skirt 28 of the deflection means 22 is arranged concentrically with respect to the jet outlet 14, for example.

The deflection means 22 has a plate 29 at its end remote from the inlet, said plate being of conical, cup-shaped, partially spherical, arched or flat design, for example. The plate 29 of the deflection means 22 can be arranged perpendicular to the propulsion jet of the nozzle 14 or obliquely thereto.

In its upper end section, the additional volume 25 has at least one circumferential opening 32 to allow fuel to emerge into the reservoir pot 5. An annular gap 33 is formed between the wall of the additional volume 25 and the deflection means 22, thus allowing fuel to flow off into the reservoir pot 5 via the annular gap 33 and the at least one circumferential opening 32. For optimum efficiency, the flow cross section in the annular gap 33 and the flow cross section of all the circumferential openings 32 should in each case be made equal to or greater than the flow cross section at the outlet of the diffuser 30.

A second suction jet pump (not shown), which draws in fuel from the immediate surroundings of the reservoir pot 5 and delivers it into the reservoir pot 5, can be provided in the reservoir pot 5. The mixing duct of this second suction jet pump can be arranged horizontally or perpendicularly with respect to the pot base 6 of the reservoir pot 5.

What is claimed is:

1. A device for delivering fuel comprising: a suction jet pump (10), which is arranged in a reservoir pot (5) and has a nozzle (14) and a mixing duct (16) provided downstream of the nozzle (14) and extending in a direction of longitudinal extent of the reservoir pot (5), wherein at an outlet of the mixing duct (16) a deflection means (22) is arranged, against which a jet of fuel exiting the nozzle (14) impinges when the mixing duct (16) is unfilled and is at least partially guided back into the mixing duct (16), characterized in that an additional volume (25) is formed at the outlet of the mixing duct (16) by an offset widening (26) of the mixing duct (16), and wherein the deflection means (22) is one of a depression, recess, receptacle and skirt (28), into which the jet of fuel exiting the nozzle (14) impinges and is guided back into the mixing duct (16), the one of the depression, recess, receptacle and skirt (28) having an inlet facing the mixing duct (16), with the inlet of the deflection means (22) extending into the additional volume (25).

2. The device as claimed in claim 1, characterized in that the widening (26) of the mixing duct (16) is one of conical, offset, step-shaped and shoulder-shaped.

3. The device as claimed in claim 1, characterized in that the additional volume (25) is angled relative to a remainder of the mixing duct (16).

4. The device as claimed in claim 1, characterized in that a diffuser (30) is formed upstream of the additional volume (25).

5. The device as claimed in claim 1, characterized in that the deflection means (22) includes a lid that covers a front end outlet of the mixing duct (16).

6. The device as claimed in claim 1, characterized in that the one of the depression, recess, receptacle and skirt (28) is one of a cylinder, channel, pot and blind hole.

7. The device as claimed in claim 1, characterized in that the one of the depression, recess, receptacle and skirt (28) has a plate (29) at an end remote from the inlet, said plate being one of a conical, cup-shaped, partially spherical, arched and flat design.

8. The device as claimed in claim 7, characterized in that the plate (29) is arranged one of perpendicular to the jet of fuel exiting the nozzle (14) and obliquely thereto.

9. The device as claimed in claim 1, characterized in that the additional volume (25) has at least one circumferential opening (32) as an outlet into the reservoir pot (5).

* * * * *

UNITED STATES PATENT AND TRADEMARK OFFICE

CERTIFICATE OF CORRECTION

PATENT NO. : 8,590,563 B2
APPLICATION NO. : 13/259276
DATED : November 26, 2013
INVENTOR(S) : Martin et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 142 days.

Signed and Sealed this
Twenty-second Day of September, 2015

Michelle K. Lee

Michelle K. Lee
*Director of the United States Patent and Trademark Office*